US008319691B2

(12) United States Patent
Tsai et al.

(10) Patent No.: US 8,319,691 B2
(45) Date of Patent: Nov. 27, 2012

(54) MULTI-BAND ANTENNA

(75) Inventors: Tiao-Hsing Tsai, Yunghe (TW); Cheng-Hsiung Wu, Kaohsiung (TW); Chao-Hsu Wu, Lujhu Township, Taoyuan County (TW)

(73) Assignee: Quanta Computer Inc., Tao Yuan Shien (TW)

( * ) Notice: Subject to any disclaimer, the term of this patent is extended or adjusted under 35 U.S.C. 154(b) by 371 days.

(21) Appl. No.: 12/789,647

(22) Filed: May 28, 2010

(65) Prior Publication Data

US 2011/0128185 A1 Jun. 2, 2011

(30) Foreign Application Priority Data

Nov. 27, 2009 (TW) ..... 98140596 A

(51) Int. Cl.
*H01Q 1/24* (2006.01)

(52) U.S. Cl. ..... 343/702; 343/700 MS
(58) Field of Classification Search ..... 343/700, 343/702, 846
See application file for complete search history.

(56) References Cited

U.S. PATENT DOCUMENTS

| | | | | |
|---|---|---|---|---|
| 4,907,006 | A * | 3/1990 | Nishikawa et al. | 343/700 MS |
| 6,054,955 | A * | 4/2000 | Schlegel et al. | 343/702 |
| 7,034,754 | B2 * | 4/2006 | Hung et al. | 343/700 MS |
| 7,233,290 | B2 * | 6/2007 | Liu et al. | 343/700 MS |
| 7,411,556 | B2 * | 8/2008 | Sanz et al. | 343/702 |
| 7,425,924 | B2 * | 9/2008 | Chung et al. | 343/702 |

* cited by examiner

*Primary Examiner* — Tho G Phan
(74) *Attorney, Agent, or Firm* — Berenato & White, LLC

(57) ABSTRACT

A multi-band antenna includes a ground section, a feed-in section, a first conductor arm, and a second conductor arm. The feed-in section has a first end, a second end opposite to the first end, and a feed-in point for feeding in radio frequency signals. The first end of the feed-in section is connected electrically to the ground section. The first conductor arm has a connecting section that extends from the second end of the feed-in section, and an extending section that extends from the connecting section, that is distal from the ground section, and that has a first end portion. The second conductor arm extends from the second end of the feed-in section, and has a second end portion that is adjacent to the first end portion of the extending section.

12 Claims, 10 Drawing Sheets

WiMAX_2300 MHz

H Plane(X-Y PLANE, $\theta$=90)

Peak = -0.2 dBi, Avg. = -3.9 dBi

E1 Plane(Z-X PLANE, $\phi$=0)

Peak = -1.4 dBi, Avg. = -4.5 dBi

E2 Plane(Y-Z PLANE, $\phi$=90)

Peak = -0.4 dBi, Avg. = -4.7 dBi

WLAN_2412 MHz

H Plane(X-Y PLANE, $\theta$=90)

Peak = -0.1 dBi, Avg. = -3.5 dBi

E1 Plane(Z-X PLANE, $\theta$=0)

Peak = -1.6 dBi, Avg. = -4.4 dBi

E2 Plane(Y-Z PLANE, $\theta$=90)

Peak = 2.3 dBi, Avg. = -4.1 dBi

WLAN_2462 MHz

H Plane(X-Y PLANE , $\theta$=90)

Peak = -0.3 dBi, Avg. = -2.6 dBi

E1 Plane(Z-X PLANE , $\phi$=0)

Peak = -1.9 dBi, Avg. = -5.2 dBi

E2 Plane(Y-Z PLANE , $\phi$=90)

Peak = 1.3 dBi, Avg. = -3.9 dBi

WiMAX_2700 MHz

H Plane(X-Y PLANE, $\theta$=90)

Peak = -0.2 dBi, Avg. = -3.3 dBi

E1 Plane(Z-X PLANE, $\phi$=0)

Peak = -2.7 dBi, Avg. = -6.2 dBi

E2 Plane(Y-Z PLANE, $\phi$=90)

Peak = 0 dBi, Avg. = -4.6 dBi

WiMAX_3300 MHz

H Plane(X-Y PLANE, $\theta$=90)

Peak = 0.8 dBi, Avg. = -2.6 dBi

E1 Plane(Z-X PLANE, $\phi$=0)

Peak = -0.9 dBi, Avg. = -4.3 dBi

E2 Plane(Y-Z PLANE, $\phi$=90)

Peak = 0.2 dBi, Avg. = -3.5 dBi

WiMAX_3800 MHz

H Plane(X-Y PLANE, $\theta$=90)

Peak = 1.4 dBi, Avg. = -1.8 dBi

E1 Plane(Z-X PLANE, $\phi$=0)

Peak = 1.8 dBi, Avg. = -2.5 dBi

E2 Plane(Y-Z PLANE, $\phi$=90)

Peak = 1.6 dBi, Avg. = -3.6 dBi

WLAN_5150 MHz

H Plane(X-Y PLANE, $\theta$=90)

Peak = 1.1 dBi, Avg. = -2.6 dBi

E1 Plane(Z-X PLANE, $\phi$=0)

Peak = -0.5 dBi, Avg. = -4.3 dBi

E2 Plane(Y-Z PLANE, $\phi$=90)

Peak = 1.1 dBi, Avg. = -4 dBi

WLAN_5875 MHz

H Plane(X-Y PLANE, $\theta$=90)

Peak = 1 dBi, Avg. = -3 dBi

E1 Plane(Z-X PLANE, $\phi$=0)

Peak = 0.3 dBi, Avg. = -3.3 dBi

E2 Plane(Y-Z PLANE, $\phi$=90)

Peak = 1 dBi, Avg. = -3.7 dBi

MULTI-BAND ANTENNA

CROSS-REFERENCE TO RELATED APPLICATION

This application claims priority of Taiwanese Application No. 098140596, filed on Nov. 27, 2009.

BACKGROUND OF THE INVENTION

1. Field of the Invention

The present invention relates to an antenna, more particularly to a multi-band antenna.

2. Description of the Related Art

Referring to FIG. 1, portable computers are often installed with a conventional planar inverted-F antenna 9 for access to 802.11a/b/g Wireless Local Area Networks (WLAN). However, as other wireless technologies, such as Worldwide Interoperability for Microwave Access (WIMAX), are developed and commercialized, portable computers nowadays need to be installed with an antenna that has smaller dimensions and that is operable in multiple frequency bands.

SUMMARY OF THE INVENTION

Therefore, an object of the present invention is to provide an antenna that is small in dimensions and that is resonant in multiple frequency bands.

Accordingly, a multi-band antenna of the present invention includes a ground section, a feed-in section, a first conductor arm, and a second conductor arm.

The feed-in section has a first end, a second end opposite to the first end, and a feed-in point for feeding in radio frequency signals. The first end of the feed-in section is connected electrically to the ground section.

The first conductor arm has a connecting section that extends from the second end of the feed-in section, and an extending section that extends from the connecting section, that is distal from the ground section, and that has a first end portion.

The second conductor arm extends from the second end of the feed-in section, and has a second end portion that is adjacent to the first end portion of the extending section.

Preferably, the ground section is elongated and has opposite first and second ends. The feed-in section has a portion disposed parallel to the ground section.

Preferably, the connecting section of the first conductor arm extends from the second end of the feed-in section in a direction from the first end of the ground section to the second end of the ground section. The second conductor arm extends from the second end of the feed-in section in a direction from the second end of the ground section to the first end of the ground section. The extending section of the first conductor arm extends from the connecting section of the first conductor arm in the direction from the second end of the ground section to the first end of the ground section.

Preferably, the multi-band antenna further includes a third conductor arm extending from the connecting section of the first conductor arm toward the ground section, and having a third end portion that is adjacent to the ground section.

Preferably, the third end portion of the third conductor arm is adjacent to the second end of the ground section.

Preferably, the second conductor arm and the connecting section of the first conductor arm are substantially L-shaped.

Preferably, the connecting section and the extending section of the first conductor arm cooperate with the second conductor arm to define a substantially L-shaped slot.

Preferably, the first end portion of the extending section is spaced apart from the second end portion of the second conductor arm by a first width, which is configured for adjusting coupling between the first end portion and the second end portion.

Preferably, the third end portion of the third conductor arm is spaced apart from the second end of the ground section by a second width, which is configured for adjusting coupling between the third end portion of the third conductor arm and the second end of the ground section.

The multi-band antenna of the present invention is operable in first, second, and third frequency bands. Through configuring the first and second widths, the impedance bandwidths of the multi-band antenna can be adjusted.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
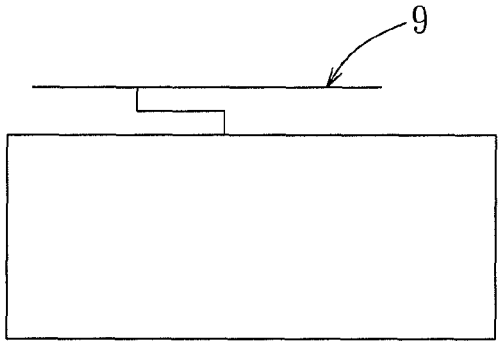
FIG. 1 PRIOR ART
FIG. 1 is a schematic diagram illustrating a conventional planar inverted-F antenna.
Figure 2:
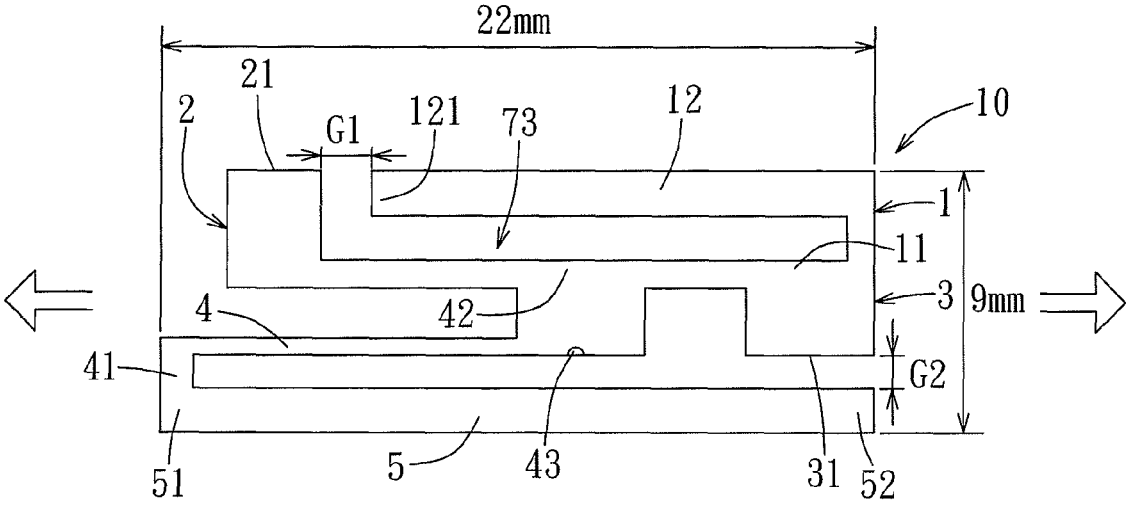
FIG. 2 is a schematic diagram illustrating the preferred embodiment of a multi-band antenna of the present invention.

Referring to FIG. 2, the preferred embodiment of a multi-band antenna 10 according to the present invention includes a first conductor arm 1, a second conductor arm 2, a third conductor arm 3, a feed-in section 4, and a ground section 5.

The ground section 5 is elongated, and has opposite first and second ends 51, 52. The feed-in section 4 has a first end 41, a second end 42 opposite to the first end 41, and a feed-in point 43 for feeding in radio frequency signals. The first end 41 of the feed-in section 4 is connected electrically to the first end 51 of the ground section 5. The feed-in section 4 has a portion disposed parallel to the ground section 5.

The first conductor arm 1 has a connecting section 11 that extends from the second end 42 of the feed-in section 4 in a direction from the first end 51 of the ground section 5 to the second end 52 of the ground section 5. The second conductor arm 2 extends from the second end 42 of the feed-in section 4 in a direction from the second end 52 of the ground section 5 to the first end 51 of the ground section 5. The second conductor arm 2 has a second end portion 21. The first conductor arm 1 further has an extending section 12 that extends from the connecting section 11 of the first conductor arm 1 in the direction from the second end 52 of the ground section 5 to the first end 51 of the ground section 5. The extending section 12 is distal from the ground section 5, and has a first end portion 121 adjacent to the second end portion 21 of the second conductor arm 2.

In the present embodiment, the second conductor arm 2 and the connecting section 11 of the first conductor arm 1 are substantially L-shaped. The connecting section 11 and the extending section 12 of the first conductor arm 1 cooperate with the second conductor arm 2 to define a substantially L-shaped slot 73 that has a first width G1. The first width G1 is configured for adjusting the amount of coupling between the extending section 12 and a combination of the connecting section 11 and the second conductor arm 2, thereby adjusting the impedance bandwidth of the multi-band antenna 10.

The third conductor arm 3 extends from the connecting section 11 of the first conductor arm 1 toward the second end 52 of the ground section 5, and has a third end portion 31 that is spaced apart from the second end 52 of the ground section 5 by a second width G2. The second width G2 is configured for adjusting the amount of coupling between the third conductor arm 3 and the ground section 5, thereby adjusting the impedance bandwidth of the multi-band antenna 10

The multi-band antenna 10 of the present embodiment has the dimensions of 22 mm×9 mm×0.6 mm (L×W×H), and is suitable to be disposed on a Printed Circuit Board (PCB) that is adapted to be disposed in an electronic device.

Figure 3:
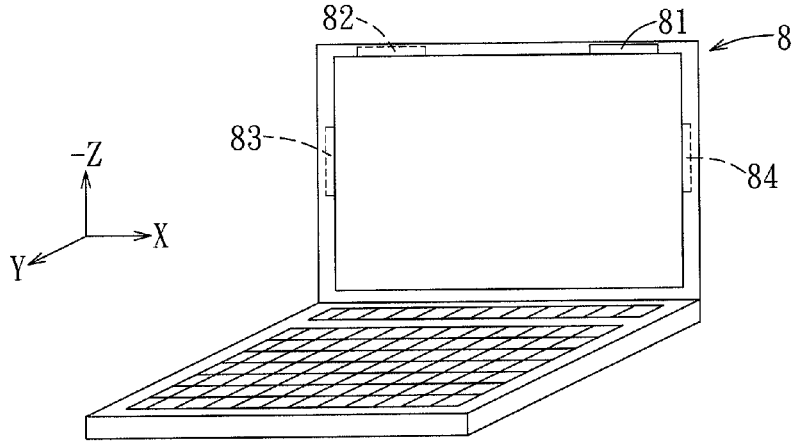
FIG. 3 is a perspective view illustrating a portable computer installed with the preferred embodiment.

In FIG. 3, a PCB having the multi-band antenna 10 of the preferred embodiment is installed in an inner space of a frame of a monitor of a portable computer 8, proximate to a top right-hand corner 81 of the frame. The ground section 5 of the multi-band antenna 10 is connected electrically to a ground plane of the portable computer 8 via a piece of copper foil (not shown). However, configuration of the PCB relative to the portable computer 8 is not limited to such. In other embodiments, the PCB can also be installed in the inner space at any of the positions indicated by the dashed-lines 82, 83, 84, according to design requirements.

Figure 4:
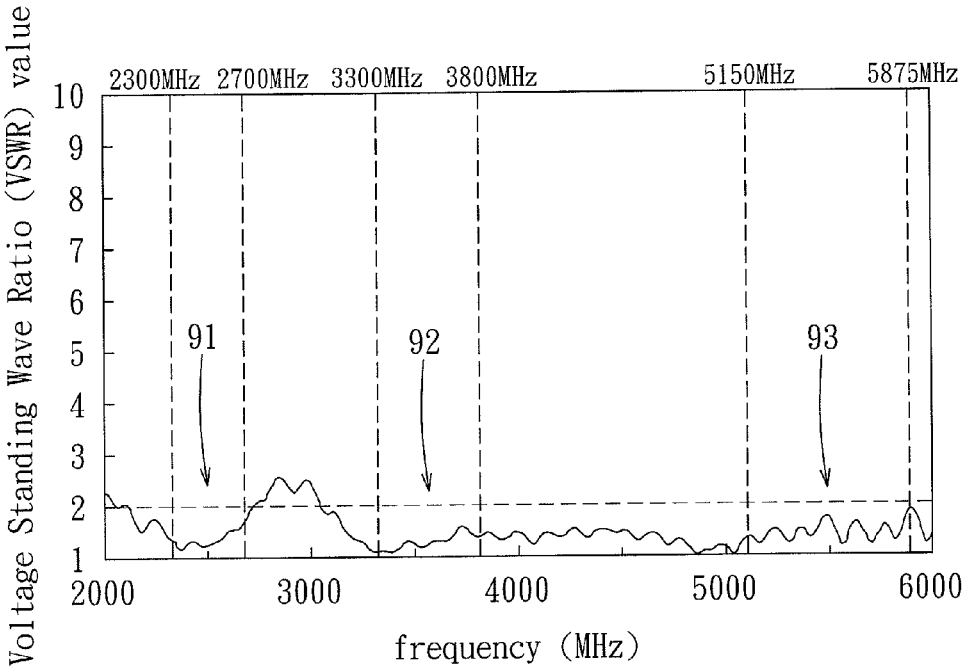
FIG. 4 is a Voltage Standing Wave Ratio (VSWR) plot of the preferred embodiment at frequencies ranging from 2000 MHz to 6000 MHz.
Figure 5:
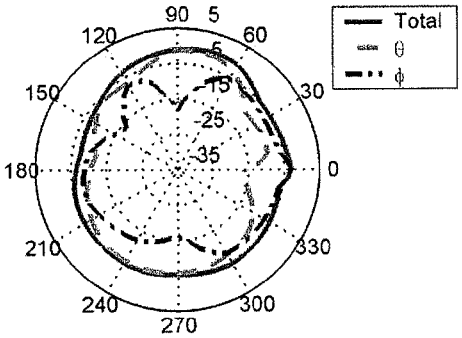
FIGS. 5 to 12 show radiation pattern diagrams of the preferred embodiment at frequencies of 2300 MHz, 2412 MHz, 2462 MHz, 2700 MHz, 3300 MHz, 3800 MHz, 5150 MHz, and 5872 MHz, respectively.
Figure 5:
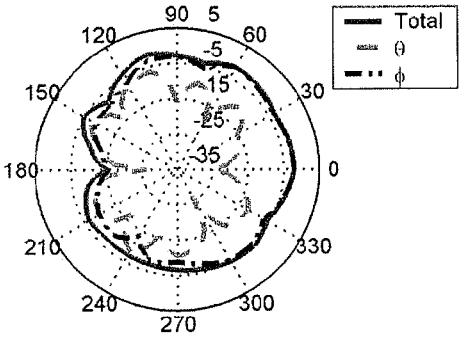
Figure 5:
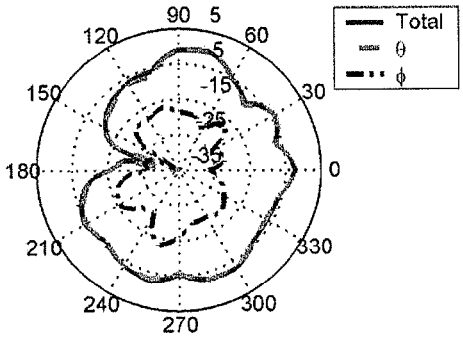
Figure 6:
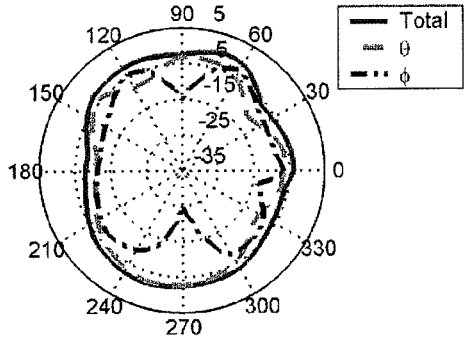
Figure 6:
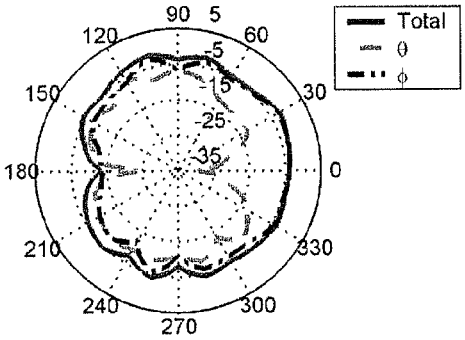
Figure 6:
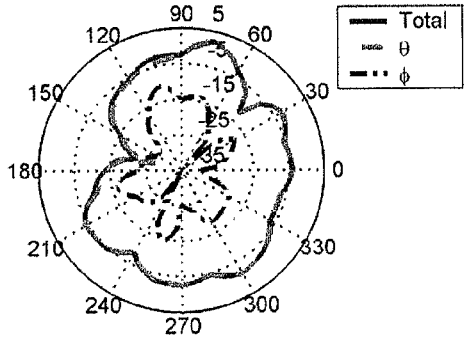
Figure 7:
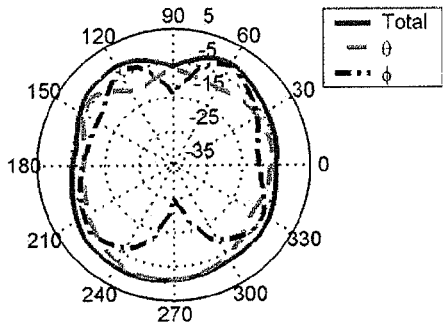
Figure 7:
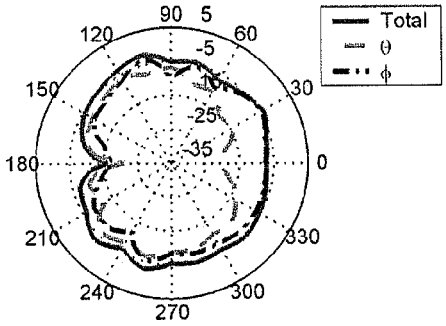
Figure 7:
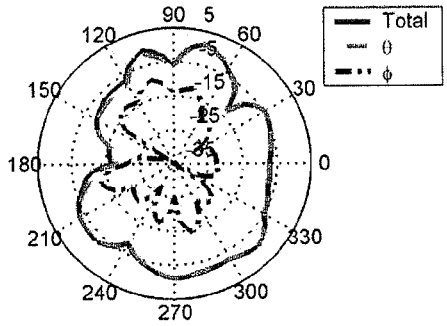
Figure 8:
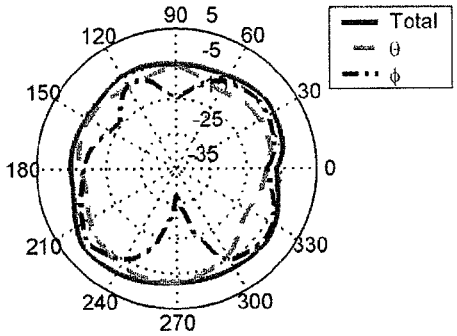
Figure 8:
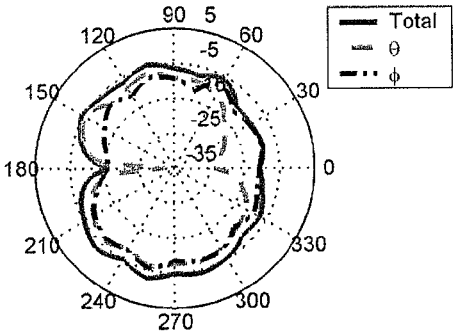
Figure 8:
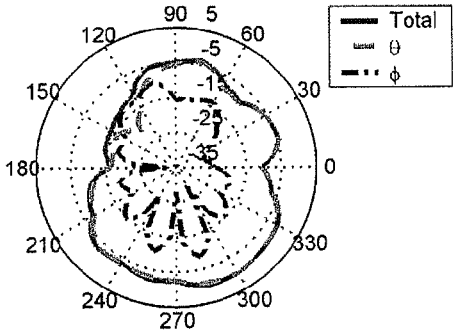
Figure 9:
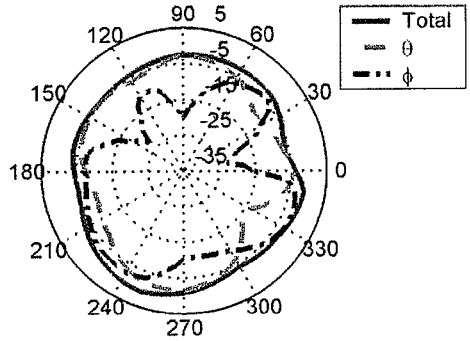
Figure 9:
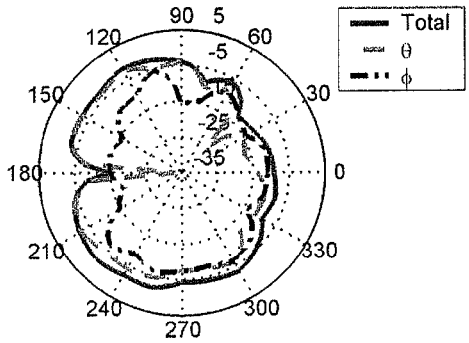
Figure 9:
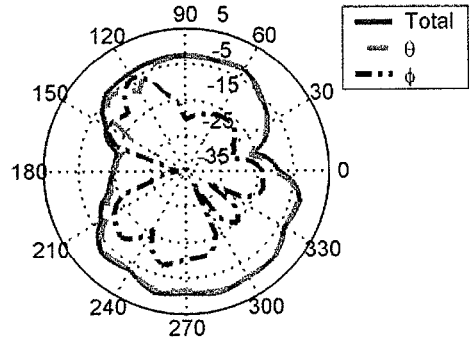
Figure 10:
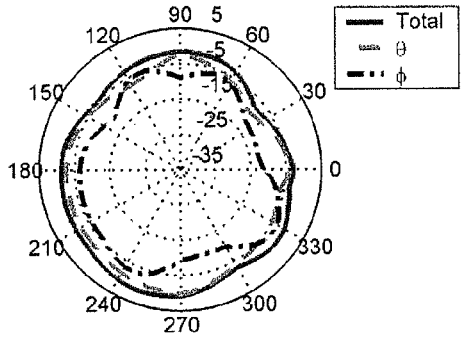
Figure 10:
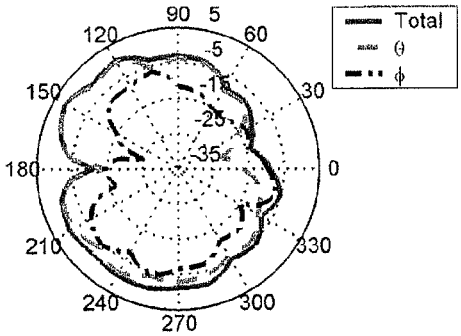
Figure 10:
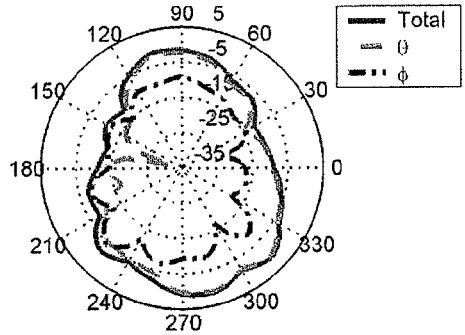
Figure 11:
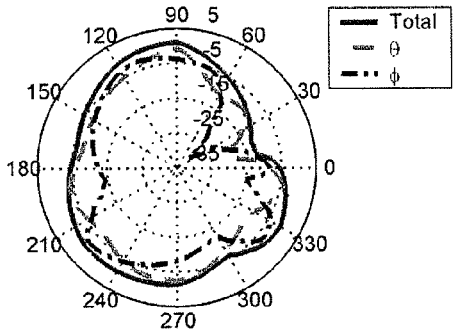
Figure 11:
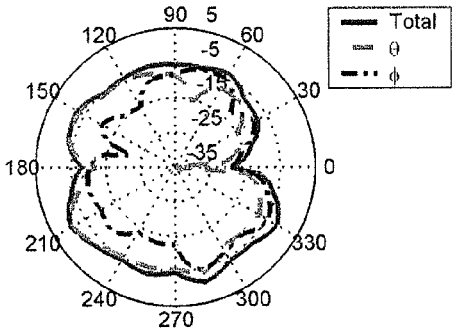
Figure 11:
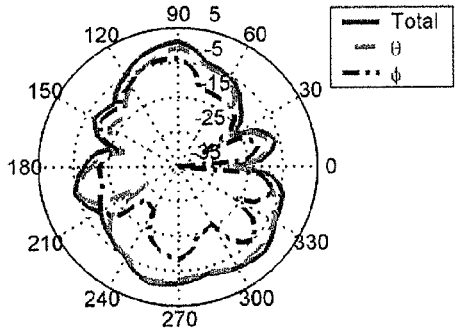
Figure 12:
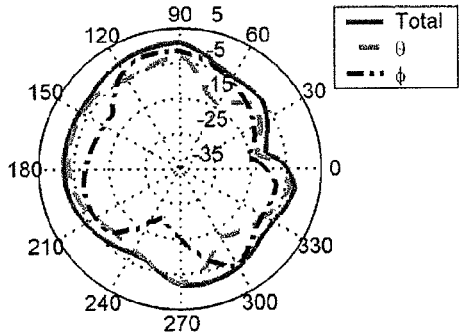
Figure 12:
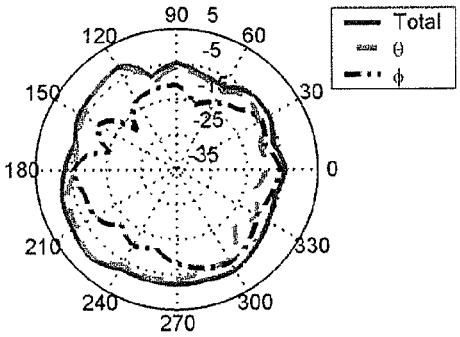
Figure 12:
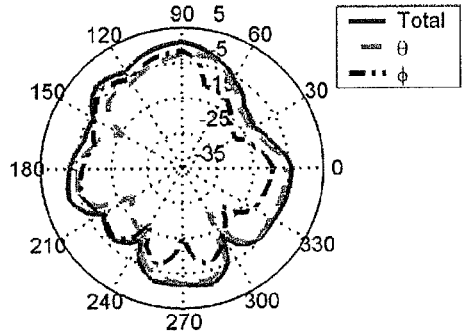

Referring to FIG. 4, the multi-band antenna 10 of the present embodiment has Voltage Standing Wave Ratio (VSWR) values below 3 at frequencies ranging from 2300 MHz to 2700 MHz, from 3300 MHz to 3800 MHZ, and from 5150 MHZ to 5875 MHz. It is to be noted that: the ground section 5, the feed-in section 4, and the first conductor arm 1 cooperate such that the multi-band antenna 10 is resonant at frequencies from 2300 MHZ to 2700 MHz in a first resonant band 91; the ground section 5, the feed-in section 4, and the second conductor arm 2 cooperate such that the multi-band antenna 10 is resonant at frequencies from 3300 MHZ to 3800 MHz in a second resonant band 92; and the ground section 5, the feed-in section 4, and the third conductor arm 3 cooperate such that the multi-band antenna 10 is resonant at frequencies from 5150 MHZ to 5875 MHz in a third resonant band 93.

Therefore, the multi-band antenna 10 is operable in: 802.11b/g Wireless Local Area Networks (WLAN), which operate at frequencies ranging from 2412 MHz to 2462 MHz; a first operating mode of Worldwide Interoperability for Microwave Access (WIMAX) networks, which operate at frequencies ranging from 2300 MHZ to 2700 MHz; a second operating mode of WIMAX networks, which operate at frequencies ranging from 3300 MHz to 3800 MHz; and 802.11a WLAN, which operate at frequencies ranging from 5150 MHz to 5875 MHz.

Table 1 shows the measured radiation efficiencies in decibels (dB) and percentages (%) at different frequencies in the frequency range of 2300 MHz to 5875 MHz. It can be noted that the radiation efficiencies are above 35%, and that the antenna gains are between −2 dB and −4.3 dB, at frequencies in the above-mentioned frequency range.

TABLE 1

| Frequency (MHz) | Efficiency (dB) | Efficiency (%) |
|---|---|---|
| 2300 | −4.3 | 37.3 |
| 2412 | −3.5 | 44.1 |
| 2437 | −3.4 | 46.0 |
| 2462 | −3.1 | 49.0 |
| 2500 | −3.4 | 46.2 |
| 2600 | −3.7 | 42.3 |
| 2700 | −3.6 | 43.8 |
| 3300 | −3.2 | 48.0 |
| 3400 | −3.0 | 50.3 |
| 3500 | −3.2 | 47.7 |
| 3600 | −3.3 | 46.5 |
| 3700 | −2.4 | 58.1 |
| 3800 | −2.6 | 55.2 |
| 5150 | −3.3 | 46.7 |
| 5350 | −3.4 | 46.1 |
| 5470 | −3.4 | 45.7 |
| 5725 | −3.8 | 41.3 |
| 5875 | −3.7 | 42.1 |

FIGS. 5 to 12 show the measured radiation patterns of the multi-band antenna 10 at frequencies of 2300 MHz (WIMAX), 2412 MHz 9 (WLAN and WIMAX), 2462 MHz (WLAN and WIMAX), 2700 MHz (WIMAX), 3300 MHz (WIMAX), 3800 MHz (WIMAX), 5150 MHz (WLAN), and 5875 MHz (WLAN), respectively. The measured radiation pattern at each of the above-mentioned frequencies is viewed in the XY, XZ, and YZ planes in a corresponding one of FIGS. 5 to 12. In each of the XY, XZ, and YZ planes of the Figures, the lighter dashed-line, the darker dashed-line, and the solid line represent the electric field (theta), the magnetic field (phi), and the total of electric and magnetic fields, respectively. It can be noted from FIGS. 5 to 12 that the radiation patterns of the multi-band antenna 10 at the above-mentioned frequencies are substantially omni-directional.

In summary, the multi-band antenna 10 of this invention is operable in the first, second, and third frequency bands 91, 92, 93. Moreover, through configuring the first and second widths G1, G2 the impedance bandwidths of the multi-band antenna 10 can be adjusted.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A multi-band antenna comprising:

a ground section;

a feed-in section having a first end, a second end opposite to said first end, and a feed-in point for feeding in radio frequency signals, said first end of said feed-in section being connected electrically to said ground section;

a first conductor arm having a connecting section that extends from said second end of said feed-in section, and an extending section that extends from said connecting section, that is distal from said ground section, and that has a first end portion; and a second conductor arm extending from said second end of said feed-in section, and having a second end portion that is adjacent to said first end portion of said extending section.

2. The multi-band antenna as claimed in claim 1, wherein said ground section is elongated and has opposite first and second ends, said feed-in section having a portion disposed parallel to said ground section.

3. The multi-band antenna as claimed in claim 2, wherein said connecting section of said first conductor arm extends from said second end of said feed-in section in a direction from said first end of said ground section to said second end of said ground section, said second conductor arm extending from said second end of said feed-in section in a direction from said second end of said ground section to said first end of said ground section, said extending section of said first conductor arm extending from said connecting section of said first conductor arm in the direction from said second end of said ground section to said first end of said ground section.

4. The multi-band antenna as claimed in claim 3, wherein said second conductor arm and said connecting section of said first conductor arm are substantially L-shaped.

5. The multi-band antenna as claimed in claim 4, wherein said connecting section and said extending section of said first conductor arm cooperate with said second conductor arm to define a substantially L-shaped slot.

6. The multi-band antenna as claimed in claim 5, wherein said first end portion of said extending section is spaced apart from said second end portion of said second conductor arm by a first width, said first width being configured for adjusting coupling between said first and second end portions.

7. The multi-band antenna as claimed in claim 3, further comprising a third conductor arm extending from said connecting section of said first conductor arm toward said ground section, and having a third end portion that is adjacent to said ground section.

8. The multi-band antenna as claimed in claim 7, wherein said third end portion of said third conductor arm is adjacent to said second end of said ground section.

9. The multi-band antenna as claimed in claim 8, wherein said second conductor arm and said connecting section of said first conductor arm are substantially L-shaped.

10. The multi-band antenna as claimed in claim 9, wherein said connecting section and said extending section of said first conductor arm cooperate with said second conductor arm to define a substantially L-shaped slot.

11. The multi-band antenna as claimed in claim 10, wherein said first end portion of said extending section is spaced apart from said second end portion of said second conductor arm by a first width, said first width being configured for adjusting coupling between said first end portion of said extending section and said second end portion of said second conductor arm.

12. The multi-band antenna as claimed in claim 8, wherein said third end portion of said third conductor arm is spaced apart from said second end of said ground section by a second width, said second width being configured for adjusting coupling between said third end portion of said third conductor arm and said second end of said ground section.

* * * * *